US005212327A

United States Patent [19]

Schuemann

[11] Patent Number: 5,212,327

[45] Date of Patent: May 18, 1993

[54] AMBIDEXTROUS THUMB SAFETY

[76] Inventor: Wilfred C. Schuemann, 705 Wagner Dr., Carson City, Nev.

[21] Appl. No.: 817,670

[22] Filed: Jan. 7, 1992

[51] Int. Cl.[5] ..... F41A 17/20

[52] U.S. Cl. ..... 42/70.01; 89/148

[58] Field of Search ..... 42/70.08, 70.01, 70.04, 42/70.05; 89/142, 148, 154

[56] References Cited

U.S. PATENT DOCUMENTS

| | | | |
|---|---|---|---|
| 1,206,892 | 12/1916 | Nelson | 89/145 |
| 3,492,748 | 2/1970 | Swenson | 42/70.01 |
| 4,414,769 | 11/1983 | Mueschke | 42/70.01 |
| 4,590,697 | 5/1986 | Ruger et al. | 42/70.08 |
| 4,742,634 | 5/1988 | Swenson | 42/70.01 |

FOREIGN PATENT DOCUMENTS

| | | | |
|---|---|---|---|
| 192343 | 8/1986 | European Pat. Off. | 42/70.01 |
| 2731893 | 2/1978 | Fed. Rep. of Germany | 42/70.08 |
| 2137324 | 10/1984 | United Kingdom | 42/70.01 |

*Primary Examiner*—Stephen M. Johnson
*Attorney, Agent, or Firm*—Cahill, Sutton, Thomas

[57] ABSTRACT

An ambidextrous thumb safety for a Model 1911A-1 type semiautomatic pistol includes a pair of pivoting interconnected left and right thumb safeties operating in concert and responsive to a thumbing action imposed upon either one. The left-hand thumb safety on the right side of the pistol includes a forwardly extending tang slidably guided within a retaining slot formed in the right side of the frame of the pistol to guide the thumb safety through a limited arcuate movement and to prevent outward translation of the left-hand thumb safety along its pivot axis.

15 Claims, 2 Drawing Sheets

AMBIDEXTROUS THUMB SAFETY

BACKGROUND OF THE INVENTION

1. Field of the Invention

The present invention relates to ambidextrous thumb safeties for handguns and, more particularly, to a thumb safety disposed on the right side of the handgun which is guided and retained by the frame during pivotal movement.

2. Description of Related Art

A left-hand thumb safety, disposed on the right side of a handgun and interconnected with the conventional left-hand thumb safety is described in U.S. Pat. No. 3,492,748, issued to A. D. Swenson. The two thumb safeties include interconnecting shafts disposed about a mutual pivot axes to insure correspondence of movement between the pair of thumb safeties. Retention of the left-handed thumb safety is achieved by a tang captured within a slot disposed in the grip plate mounted on the right side of the handgun. An improvement for retaining the left-hand thumb safety for a handgun is described in U.S. Pat. No. 4,414,769 issued to H. W. Mueschke. The sear pin of the handgun extends past the gun frame on the right-hand side to accommodate formation of a slot disposed in the extended part of the sear pin. The left-handed thumb safety includes an arcuate flange engaging the slot in the sear pin, which slot prevents lateral translation of the left-hand thumb safety. In U.S. Pat. No. 4,742,634, issued to A. D. Swenson, guards associated with the left and right hand thumb safeties of a handgun prevent potentially injurious contact between a user's thumb and rearward movement of the slide upon discharge of the handgun.

SUMMARY OF THE INVENTION

A pair of opposed left and right-hand thumb safeties are disposed on opposed sides of the frame of a handgun, such as a semiautomatic pistol. shafts extending inwardly into the frame from each thumb safety interconnect with a tongue and groove mechanism to insure corresponding movement of the thumb safeties. A slot is disposed on the right-hand side of the frame to receive and guide a tang extending forwardly from the left-handthumb safety during normal angular movement of thumb safeties and to prevent lateral displacement of the left-hand thumb safety along the axis of its pivot shaft.

It is therefore a primary object of the present invention to provide handgun frame retained ambidextrous thumb safeties.

Another object of the present invention is to provide a handgun frame for receiving and retaining a left-handed thumb safety.

Yet another object of the present invention is to provide a low wear rate guide mechanism in a handgun frame for accommodating pivotal movement and retention of a left-hand thumb safety.

A still further object o the present invention is to provide a left-hand thumb safety for a handgun having a forwardly extending tang for engaging a slot formed in the frame of a handgun.

A further object of the present invention is to provide a handgun frame of a semiautomatic pistol having a slot for retaining and guiding a forwardly extending tang of a left-hand thumb safety.

A yet further object of the present invention is to provide a handgun frame of a semiautomatic pistol for supporting and guiding a left-hand thumb safety which is disassemblable during a normal field strip.

A still further object of the present invention is to provide a method for retaining, guiding and accommodating limited arcuate movement of a left-hand thumb safety relative to a handgun frame of a semiautomatic pistol.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

A semiautomatic pistol, which has been produced by several manufacturers, is referred to as Model 1911. This was an army issue .45-caliber handgun which operated very well under adverse conditions with an acceptable degree of accuracy while discharging a projectile of significant kinetic energy. Many variants of this handgun, including different calibers, have been developed over the years.

In the field of competitive shooting, matches of national and international significance are presently ongoing and which involve handguns of this type. In such competitions, certain competitors shoot left-handed and certain competitive skills to be demonstrated require shooting with each hand. A conventional Model 1911 handgun includes a right-handed thumb safety disposed on the left side of the handgun. This safety is essentially impossible to operate when the handgun is held in the left hand and requires either awkward manipulation of the left hand or assistance by the right hand. In competition shooting, speed and fluidity of motion are paramount and the presence of a right-hand thumb safety is essentially mandatory in order for the shooter to be competitive.

Figure 1:
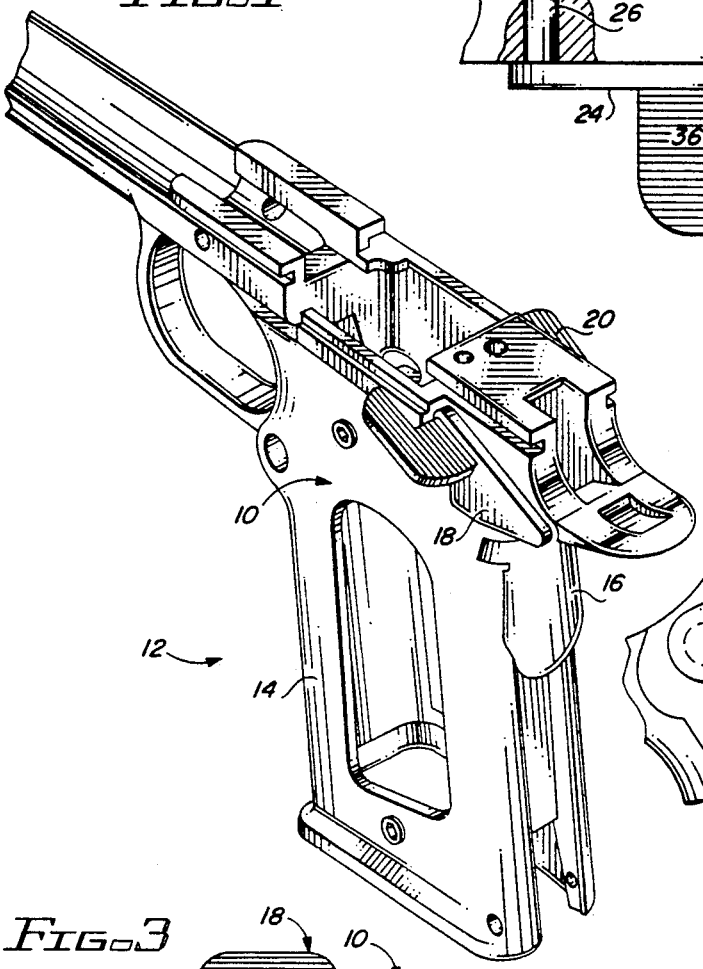
FIG. 1 is an isometric view of a handgun frame incorporating the present invention.
Figure 4:
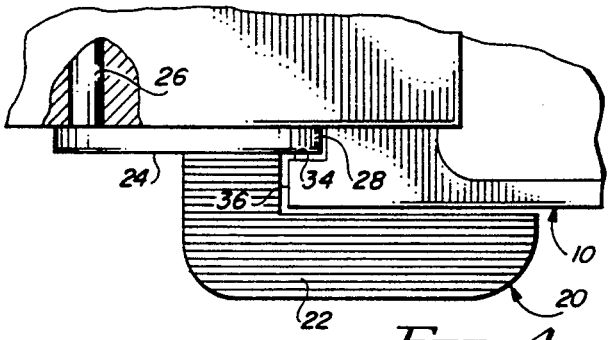
FIG. 4 is a detail view taken within circumscribed line 4 shown in FIG. 3.
Figure 5:
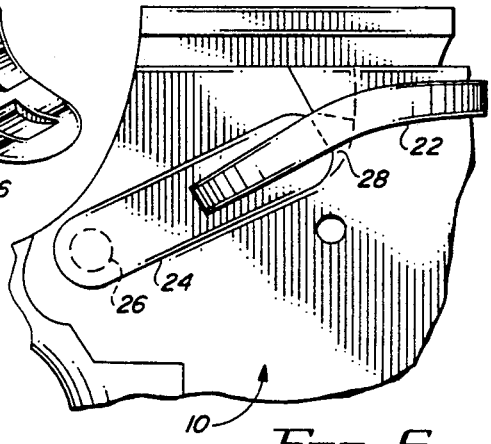
FIG. 5 is a partial detail view taken within circumscribed line 5 shown in FIG. 2.
Figure 6:
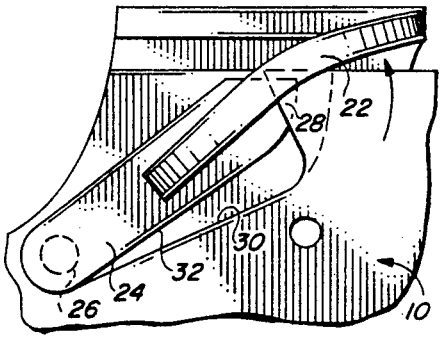
FIG. 6 illustrates a second position of the left-hand thumb safety shown in FIG. 5.
Figure 3:
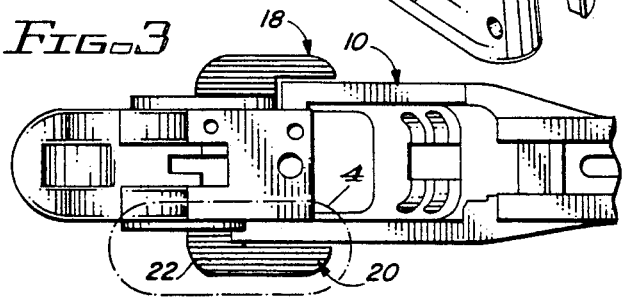
FIG. 3 is a partial top view of the handgun frame.
Figure 2:
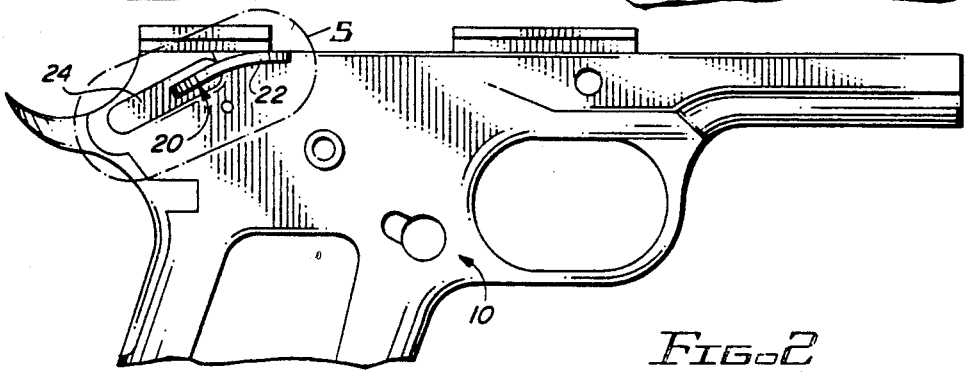
FIG. 2 is a side view of the right-hand side of the handgun frame.

Referring to FIGS. 1 and 2, there is shown a frame 10 of a handgun 12 similar to a Model 1911 semiautomatic pistol. Grip handle 14 supports grip safety 16. A right-hand thumb safety 18 is disposed on the left side of the frame; this thumb safety is of the conventional type generally operable by a user's right thumb. Upon pivoting the right-hand thumb safety downwardly, the slide (not shown) is released to permit rearward movement of the slide and the hammer may strike the firing pin. Left-hand thumb safety 20 is interconnected with the right-hand thumb safety, as described in further detail below.

Referring jointly to FIGS. 3–6, the left-hand thumb safety will be described in further detail. It includes a pad 22, which may be ribbed, as illustrated, cross-hatched or otherwise having a surface worked to minimize the likelihood of slippage upon engagement with a shooter's thumb. The pad extends laterally from plate 24. The plate is pivotally mounted within frame 10 by means of a pivot shaft 26 journalled in frame 10. A tang 28 is disposed at the fore end of plate 24. Frame 10 includes a shoulder 30 for supporting edge 32 of plate 24 when left-hand thumb safety 20 is in its clockwise-most position (as viewed in FIGS. 2, 5, and 6). A slot 34 for receiving tang 28 is formed within frame 10 upwardly from shoulder 30. The slot serves the purpose of guiding tang 28, and left-hand thumb safety 20, during normal pivotal movement of the safety, irrespective of whether the movement is induced by a force acting upon the right or left-handed thumb safeties. Because lip 36 is on the nature of an overhang, it will preclude tang 28 from being displaced laterally and parallel to the axis of shaft 26 while the tang is disposed within its slot 34. Thereby, lateral displacement of left-hand thumb safety is precluded while the tang is within its slot. To obtain disengagement of the tang from within its slot handgun 12 must be field-stripped.

Figure 7:
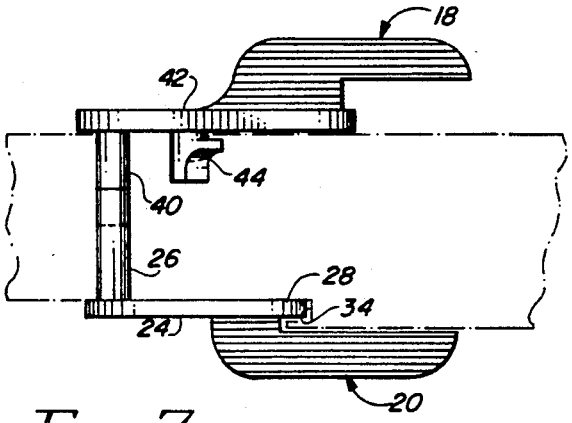
FIG. 7 is a top view illustrating the interconnection and positional relationship of left and right-hand thumb safeties relative to the handgun frame.
Figure 8:
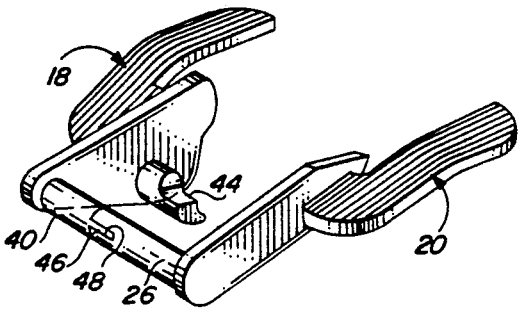
FIG. 8 is an isometric view illustrating the left and right-hand thumb safeties.
Figure 9:
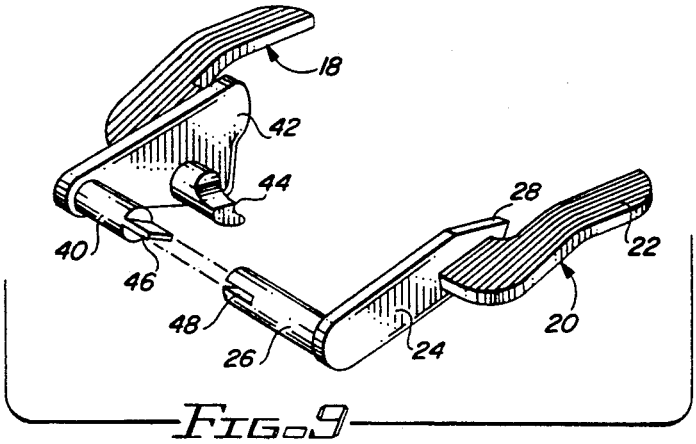
FIG. 9 is an isometric view illustrating interconnection between the right and left-hand thumb safeties.
Figure 10:
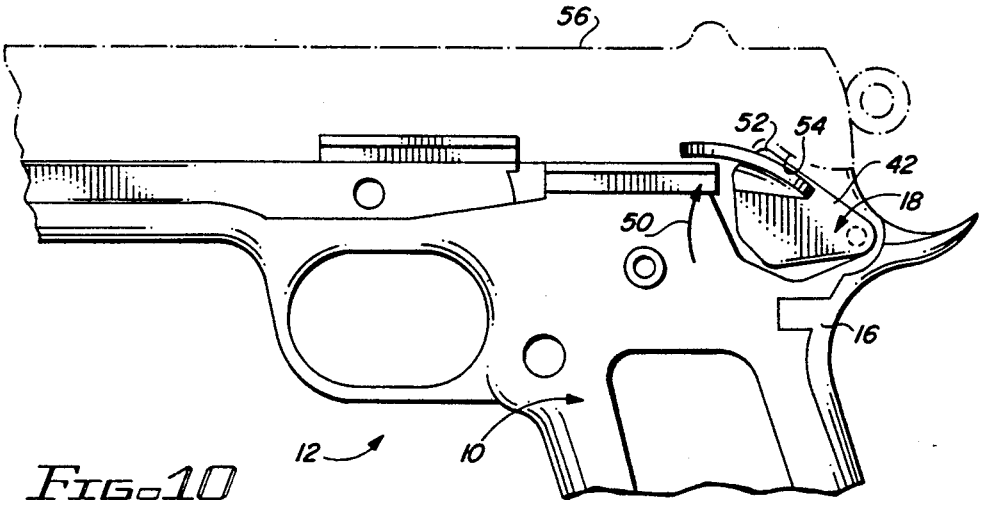
FIG. 10 illustrates movement of the thumb safeties to the safety position.

Referring jointly to FIGS. 7, 8 and 9, details attendant the interconnection between the left and right-hand thumb safeties will be described. As is conventional, right-hand thumb safety 18 includes a shaft 40 extending from plate 42, which shaft is journalled within frame 10 of the handgun. A stub 44 also extends from plate 42 into frame 10; this stub relates to operation of the firing mechanism of the handgun. The end of shaft 40 is modified to include a tongue 46. A groove 48 is disposed at the terminal end of shaft 26 for receiving tongue 46. Upon mating of tongue 46 with groove 48, as illustrated in FIG. 8, any rotational movement of either shaft produces a commensurate rotational movement of the other shaft. Thus, a downward force imposed upon either of the sum safeties will result in a commensurate downward movement of right-hand thumb safety 18 and the gun may be fired. Referring briefly to FIG. 10, further details attendant the safety provided by right-hand thumb safety 18 will be discussed. Upon clockwise movement of left-hand thumb safety, as depicted by arrow 50, corner 52 of plate 42 will be penetrably engage a notch 54 formed in the lower left-hand edge of slide 56. Such engagement will be preclude rearward movement of the slide. Furthermore, stub 44, internal of frame 10, will interferingly engage the firing mechanism to prevent the firing pin striking the percussion cap of a bullet in the firing chamber of the handgun.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

What is claimed is:

1. Apparatus for retaining and guiding a left-hand thumb safety engaged with and operating in concert with a right-hand thumb safety, each of the left-hand and right-hand thumb safeties being pivotally mounted in a frame of a piston, said apparatus comprising in combination:

a) a first pivot shaft extending from the right-hand thumb safety into the frame of the pistol;

b) a second pivot shaft extending from the left-hand thumb safety into the frame of the pistol;

c) means for interconnecting said first and second pivot shafts to prevent independent rotation between the left and right-hand thumb safeties;

d) a tang extending from the left-hand thumb safety; and e) a slot disposed in the frame of the pistol for receiving said tang, for guiding said tang upon pivotal movement of the left-hand thumb safety and for preventing disengagement of the left-hand thumb safety from the right-hand thumb safety while said tang is disposed within said slot.

2. The apparatus as set forth in claim 1, wherein said left-hand thumb safety includes a plate support said second pivot shaft and wherein said tang extends from said plate.

3. The apparatus as set forth in claim 2, including a pad extending from said plate for responding to a force applied by a user of the pistol to urge pivotal movement of the left-hand and right-hand thumb safeties.

4. The apparatus as set forth in claim 2, wherein the frame includes a shoulder for supporting said plate.

5. The apparatus as set forth in claim 1, wherein said frame includes a lip for defining said slot adjacent the frame.

6. The apparatus as set forth in claim 1, wherein said slot includes an opening facing rearwardly along the frame and toward said second pivot shaft.

7. The apparatus as set forth in claim 6, wherein said opening of said slot accommodates arcuate translatory movement of said tang within said slot.

8. The apparatus as set forth in claim 6, wherein said opening of said slot accommodates disengagement of said tang with said slot upon upward pivotal movement of the left-hand thumb safety relative to the pistol during field stripping of the pistol.

9. Apparatus for retaining and guiding a left-hand thumb safety operating in concert with a right-hand thumb safety of a pistol having a unitary frame, said apparatus comprising in combination;

a) means for pivoting in concert the left-hand and right-hand thumb safeties about a common pivot axis; and b) means for inhibiting lateral movement of the left-hand thumb safety along the pivot axis, said inhibiting means including tang means extending from the left-hand thumb safety and slot means disposed in the unitary frame for receiving said tang means, for guiding said tang means upon pivotal movement of the left-hand thumb safety about the pivot axis and for preventing displacement of the left-hand thumb safety along the pivot axis while said tang means is disposed in said slot means.

10. The apparatus as set forth in claim 9, wherein said slot means includes means for accommodating withdrawal of said tang means from said slot means upon field stripping of the pistol.

11. The apparatus as set forth in claim 9, wherein said slot means is a part of the unitary frame of the pistol.

12. The apparatus as set forth in claim 9, wherein said slot means includes means for limiting pivotal movement of the left-hand thumb safety in one direction about the pivot axis.

13. Apparatus for providing an ambidextrous safety for a semiautomatic handgun, said apparatus comprising in combination:

a) a frame for the handgun;
b) a right-hand thumb safety;
c) means for pivotally mounting said right-hand thumb safety with said frame;
d) a left-hand thumb safety;
e) means for pivotally mounting said left-hand thumb safety with said frame;
f) means for interconnecting said right and left-hand thumb safeties;
g) an extension extending from said left-hand thumb safety;
h) means disposed in said frame for slidably receiving said extension to prevent disengagement of said left-hand thumb safety from said frame while accommodating pivotal movement of said left-hand and right-hand thumb safeties; and
i) means for disengaging said extension from said receiving means upon field stripping the handgun.

14. The apparatus as set forth in claim 13, wherein said frame includes a lip for defining said receiving means.

15. The apparatus as set forth in claims 13, wherein said receiving means includes an opening disposed rearwardly and upwardly relative to the handgun.

* * * * *